US011135801B2

(12) United States Patent
Asai

(10) Patent No.: US 11,135,801 B2
(45) Date of Patent: Oct. 5, 2021

(54) PRODUCTION METHOD FOR PLEATED FILM, AND PRODUCTION METHOD OF PLEATED PACKAGING BODY

(71) Applicant: Chokoku Plast Corporation, Osaka (JP)

(72) Inventor: Kenichi Asai, Osaka (JP)

(73) Assignee: CHOKOKU PLAST CORPORATION, Osaka (JP)

( * ) Notice: Subject to any disclaimer, the term of this patent is extended or adjusted under 35 U.S.C. 154(b) by 163 days.

(21) Appl. No.: 16/478,325

(22) PCT Filed: Jan. 15, 2018

(86) PCT No.: PCT/JP2018/000862
§ 371 (c)(1),
(2) Date: Jul. 16, 2019

(87) PCT Pub. No.: WO2018/135445
PCT Pub. Date: Jul. 26, 2018

(65) Prior Publication Data

US 2019/0358926 A1 Nov. 28, 2019

(30) Foreign Application Priority Data

Jan. 18, 2017 (JP) ..... JP2017-006528

(51) Int. Cl.
*B31B 70/52* (2017.01)
*B65B 9/073* (2012.01)
(Continued)

(52) U.S. Cl.
CPC ..... *B31B 70/52* (2017.08); *B65B 9/073* (2013.01); *B31B 2150/0012* (2017.08);
(Continued)

(58) Field of Classification Search
CPC ..... B65B 9/073; B65B 9/2049; B65B 9/213; B31B 70/261; B31B 70/008; B31B 70/52;
(Continued)

(56) References Cited

U.S. PATENT DOCUMENTS 4,522,676 A * 6/1985 Masao ..... B29C 53/36 156/204
7,252,732 B2 * 8/2007 Karolyi ..... B31B 70/00 156/204
(Continued)

FOREIGN PATENT DOCUMENTS

DE 2318420 A1 10/1974
EP 1459995 A1 9/2004
(Continued)

OTHER PUBLICATIONS

European Search Report for corresponding application EP 18 74 2146 dated Oct. 23, 2020 (5 pages).
(Continued)

*Primary Examiner* — Thomas M Wittenschlaeger
(74) *Attorney, Agent, or Firm* — Flynn Thiel, P.C.

(57) ABSTRACT

A production method for a pleated film according to the present invention includes an introduction step for moving an elongated film for use as a packaging body and introducing the film into a gap between a pair of pleat-forming plates disposed with a gap therebetween so that respective inner surfaces of the film oppose each other, a fixing step for fixing the film to the pair of pleat-forming plates, and a step for forming a pleat extending in a latitudinal direction of the film by closing the gap between the pair of pleat-forming plates, wherein sealing bars are provided on the pair of pleat-forming plates on opposing surfaces of the pleat-forming plates.

20 Claims, 8 Drawing Sheets

(51) Int. Cl.

| | |
|---|---|
| *B31B 150/00* | (2017.01) |
| *B65B 9/20* | (2012.01) |
| *B65B 9/213* | (2012.01) |
| *B65D 75/00* | (2006.01) |

(52) U.S. Cl.
CPC ..... *B65B 9/2049* (2013.01); *B65B 9/213* (2013.01); *B65D 75/008* (2013.01)

(58) Field of Classification Search
CPC ..... B31B 70/642; B31B 70/266; B31B 2150/0012; B31B 2160/20; B31B 2170/30; B65D 75/008
See application file for complete search history.

(56) References Cited

U.S. PATENT DOCUMENTS

| | | | | |
|---|---|---|---|---|
| 8,387,348 | B2 * | 3/2013 | Caudle | B65B 55/103 53/426 |
| 10,689,142 | B2 * | 6/2020 | Sanfilippo | B65B 51/26 |
| 2017/0015454 | A1 * | 1/2017 | Sanfilippo | B29C 66/431 |

FOREIGN PATENT DOCUMENTS

| | | | |
|---|---|---|---|
| JP | 2003-191963 | A | 7/2003 |
| JP | 2003-200506 | A | 7/2003 |
| JP | 2003-231189 | A | 8/2003 |
| JP | 2008-133051 | A | 6/2008 |
| WO | WO 2000/007903 | A1 | 2/2000 |

OTHER PUBLICATIONS

Notification of Transmittal of Translation of International Preliminary Report, in English, issued in International Application No. PCT/JP2018/000862 dated Aug. 1, 2019 (1 page).
International Preliminary Report on Patentability, in English, issued in International Application No. PCT/JP2018/000862, date of issuance Jul. 23, 2019 (1 page).
English translation of the Written Opinion of the International Searching Authority issued in International Application No. PCT/JP2018/000862, dated Mar. 27, 2018 (3 pages).
Japanese International Search Report and Written Opinion for corresponding PCT/JP2018/000862 (6 pgs).
English International Search Report for corresponding PCT/JP2018/000862 (2 pgs).

* cited by examiner

PRODUCTION METHOD FOR PLEATED FILM, AND PRODUCTION METHOD OF PLEATED PACKAGING BODY

TECHNICAL FIELD

The present invention relates to a production method for a pleated film and a production method of a pleated packaging body.

BACKGROUND ART

In a packaging bag available in the prior art, a pleat provided in a bottom surface portion of the packaging bag acts as a pedestal, thus providing the packaging bag with an improved self-standing property. In this packaging bag, the pleat is formed integrally with the packaging bag so as to assist the packaging bag in self-standing vertically.

Japanese Patent Application Publication No. 2003-191963, for example, discloses a pleated self-standing packaging bag, in which a palm-folding type rib is formed by adhering respective inner faces of end edges of a packaging material in an up-down direction of the packaging bag, and one or more pleats extend in a right angle direction relative to the up-down direction of the packaging bag. The pleat is formed on the edges between a folded bottom face portion and front face, back face, and side face portions, and extends from the front face, back face, and side face portions so as to be coplanar therewith. In this pleated self-standing packaging bag, the pleat is formed on the lower end of the packaging bag by folding back a packaging material so as to form a three-ply strip and heat-sealing the inner surfaces of the folded back portions. The pleat thus serves to conceal the bottom face portion of the packaging bag. With this configuration, a pleat that does not crease and that exhibits a superior sealing performance is obtained.

To manufacture a conventional pleated self-standing packaging bag, as described in Japanese Patent Application Publication No. 2003-200506, for example, first, a film in which pleats are formed at a predetermined pitch so as to extend in strip form in an orthogonal direction to a feed direction of the film is formed, and then the film is used to form a bag shape. Further, there is no particular need to form the pleats in the film and manufacture the packaging bag continuously, and therefore, as described in Japanese Patent Application Publication No. 2003-231189, for example, after forming the pleats in the film, the film may be rolled up and used as a rolled web.

Furthermore, Japanese Patent Application Publication No. 2008-133051 discloses a configuration in which a cut-out portion is formed in a part of a pleat of a pleated self-standing packaging bag. In this pleated self-standing packaging bag, as shown in FIG. 15, a cut-out portion 153 is formed in a pleat 151 in a part that intersects a rib 152, the rib 152 being formed by adhering inner surfaces of end edges of a packaging material in the up-down direction of the packaging bag. As a result, the heat-sealing performance in the intersecting portion between the rib on the lower end of the pleated self-standing packaging bag and the pleat that is orthogonal thereto improves. Moreover, the intersecting part between the rib and the pleat can be bent at a more acute angle, leading to an improvement in the self-standing stability of the pleated self-standing packaging bag material, and as a result, a superior design is obtained.

SUMMARY OF INVENTION

Technical Problem

Japanese Patent Application Publication No. 2003-200506 and Japanese Patent Application Publication No. 2003-231189 state that in order to form the pleat in the film, a packaging material having at least a heat-sealable inner surface is moved either intermittently and repeatedly or continuously so that the outer surface of the packaging material slides over slit-forming plates disposed on an upstream side and a downstream side with a required gap therebetween, and when the intermittent movement of the packaging material is stopped or the continuous movement is relatively stopped, a pleat-folding plate is thrust into the gap between the slit-forming plates so that the respective inner surfaces of packaging materials are folded over into the shape of palm-folding type and a pleat is folded so as to extend in a right angle direction relative to the extension direction of the packaging material. The folded pleat portion is then heat-sealed so as to form a pleat.

However, the present inventors and so on found, as a result of repeated study, that there remains room for improvement in the methods described in Japanese Patent Application Publication No. 2003-200506 and Japanese Patent Application Publication No. 2003-231189 in terms of the following points.

First, when the pleat-folding plate is used in the pleat folding part in order to fold the film over into the shape of palm-folding type, depending on the materials of the film and the pleat-folding plate, the pleated part of the film may be damaged. Further, after pressing the pleat-folding plate against the film in order to fold the pleat and before heat-sealing the folded pleat portion, the pleat-folding plate must be raised, but at this time, the film is raised together with the pleat-folding plate, and as a result, a formation defect may occur in the pleat. Furthermore, as described above, three steps, namely pressing the pleat-folding plate against the film, raising the pleat-folding plate, and heat-sealing the folded pleat portion, are required, and therefore forming the pleat is time-consuming.

Hence, an object of the present invention is to provide a production method for a pleated film with which, when a pleat is formed in a pleated film, the film is not damaged, no formation defects occur in the pleat, and the pleated film can be manufactured quickly.

Solution to Problem

To solve the problems described above, the present invention employs the following configurations.

(1) A production method for a pleated film, including:

an introduction step for moving an elongated film for use as a packaging body in a longitudinal direction of the film and introducing the film into a gap part between a pair of pleat-forming plates disposed with a gap therebetween so that an upstream-side inner surface and a downstream-side inner surface of the film oppose each other;

a fixing step for fixing the film to the pair of pleat-forming plates; and a pleat-forming step for forming a pleat extending in a latitudinal direction of the film by closing the gap between the pair of pleat-forming plates, wherein sealing bars are provided on the pair of pleat-forming plates on opposing surfaces of the pair of pleat-forming plates, and the introduction step is performed using at least one of following methods (A) to (C):

(A): a method in which the film is introduced into the gap between the pair of pleat-forming plates so that the upstream-side inner surface and the downstream-side inner surface of the film oppose each other by blowing air from the inner surface side of the film;

(B): a method in which the film is introduced into the gap between the pair of pleat-forming plates so that the upstream-side inner surface and the downstream-side inner surface of the film oppose each other by suctioning gas from the atmosphere through a suction member disposed on the outer surface side of the gap part between the pair of pleat-forming plates; and (C): a method in which the film is introduced into the gap between the pair of pleat-forming plates so that the upstream-side inner surface and the downstream-side inner surface of the film oppose each other by a pair of rollers disposed on the outer surface side of the film.

(2) A production method for a pleated film, including:

a fixing step for moving an elongated film for use as a packaging body in a longitudinal direction of the film and fixing the film to a pair of pleat-forming plates disposed with a gap therebetween;

an introduction step for introducing the film into the gap part between the pair of pleat-forming plates so that an upstream-side inner surface and a downstream-side inner surface of the film oppose each other while closing the gap between the pair of pleat-forming plates; and a pleat-forming step for forming a pleat extending in a latitudinal direction of the film by closing the gap between the pair of pleat-forming plates, wherein sealing bars are provided on the pair of pleat-forming plates on opposing surfaces of the pair of pleat-forming plates, and the introduction step is performed using a following method (A) and/or a following method (B):

(A): a method in which the film is introduced into the gap between the pair of pleat-forming plates so that the upstream-side inner surface and the downstream-side inner surface of the film oppose each other by blowing air from the inner surface side of the film; and (B): a method in which the film is introduced into the gap between the pair of pleat-forming plates so that the upstream-side inner surface and the downstream-side inner surface of the film oppose each other by suctioning gas from the atmosphere through a suction member disposed on the outer surface side of the gap part between the pair of pleat-forming plates.

(3) The production method for a pleated film according to (1) or (2), wherein the film is fixed to the pair of pleat-forming plates by suctioning gas from the atmosphere through a plurality of holes provided in the pair of pleat-forming plates.

(4) The production method for a pleated film according to any of (1) to (3), wherein the film is fixed to the pair of pleat-forming plates by blowing air from the inner surface side of the film.

(5) The production method for a pleated film according to any of (1) to (4), wherein the film is fixed to the pair of pleat-forming plates by gripping the film between a pair of film-retaining plates provided on the inner surface side of the film and the pair of pleat-forming plates.

(6) The production method for a pleated film according to any of (1) to (5), wherein the film is fixed to the pair of pleat-forming plates by gripping the film between an inner surface-side roller and an outer surface-side roller provided respectively on an upstream side and a downstream side of the pair of pleat-forming plates.

(7) The production method for a pleated film according to any of (1) and (3) to (6), wherein an amount of the film required to form the pleat is fed by nip rolls disposed respectively on the upstream side and the downstream side of the pair of pleat-forming plates.

(8) The production method for a pleated film according to any of (1) to (7), including a step for cutting out a portion of the film in a part where the pleat is to be formed using a die or a blade following the pleat-forming step.

(9) The production method for a pleated film according to any of (1) to (7), wherein, while forming the pleat extending in the latitudinal direction of the film by closing the gap between the pair of pleat-forming plates in the pleat-forming step, a portion of the film in a part where the pleat is to be formed is cut out using a die or a blade disposed on a part of the sealing bar.

(10) A production method of a pleated packaging body, including producing a pleated packaging body by supplying the pleated film obtained using the production method for a pleated film according to any of (1) to (9) to a packaging machine capable of producing a pillow-type packaging body.

(11) The production method of a pleated packaging body according to (10), wherein the packaging machine is a horizontal pillow packaging machine including:

means for conveying the film;

means for forming the film into a tubular shape and housing content therein;

means for forming a center seal in the tubular film;

means for simultaneously sealing a part of the center-sealed film that is to serve as an upstream-side end of a downstream-side packaging body and a part of the center-sealed film that is to serve as a downstream-side end of an upstream-side packaging body; and means for cutting the sealed part substantially in the center thereof in order to separate the film that is to serve as the upstream-side packaging body from the downstream-side packaging body.

(12) The production method of a pleated packaging body according to (10), wherein the packaging machine is a vertical pillow packaging machine including:

means for conveying the film;

means for forming the film into a tubular shape;

means for forming a center seal in the tubular film;

means for simultaneously sealing a part of the center-sealed film that is to serve as an upstream-side end of a downstream-side packaging body and a part of the center-sealed film that is to serve as a downstream-side end of an upstream-side packaging body;

means for cutting the sealed part substantially in the center thereof in order to separate the film that is to serve as the upstream-side packaging body from the downstream-side packaging body; and means for supplying content through an open end of the film that is to serve as the upstream-side packaging body.

Advantageous Effects of Invention

According to the present invention, it is possible to provide a production method for a pleated film with which, when a pleat is formed in a pleated film, the film is not damaged, no formation defects occur in the pleat, and the pleated film can be manufactured quickly.

DESCRIPTION OF EMBODIMENTS

<Production Method for Pleated Film>

In a production method for a pleated film according to the present invention, an elongated film for use as a packaging body is used as a starting material. The film is fed from a rolled web, for example, and moved either intermittently or continuously in a longitudinal direction of the film. When a pleat is to be formed by heat-sealing, for example, the film should be heat-sealable on at least the surface thereof that is to form the inside of the pleat, while the surface thereof that forms the outside may be either heat-sealable or non-heat-sealable.

Note that in the present invention, the surface of the film that is folded and adhered when forming the pleat will be referred to as an "inner surface", and the surface on the opposite side thereto will be referred to as an "outer surface".

In a case where the film is moved intermittently, the pleat may be formed in the film when the film is stopped. In a case where the film is moved continuously, the pleat may be formed in the film while a feed amount of the film is adjusted using a dancer roller or the like, for example, and the film is stopped between a pair of pleat-forming plates. Further, the pleat-forming plates may perform a box motion and the pleat may be formed in a state where the film is stopped relative to the pair of pleat-forming plates.

The pleat is formed using a pair of pleat-forming plates disposed on the outer surface side of the film. The pair of pleat-forming plates are disposed with a gap therebetween, and sealing bars are provided on the mutually opposing surfaces of the pleat-forming plates. The film is introduced into the gap between the pair of pleat-forming plates so that an upstream-side inner surface and a downstream-side inner surface of the film oppose each other. The film is then fixed to the pleat-forming plates, whereupon the gap between the pleat-forming plates is closed, and as a result, the part of the film gripped between the pair of pleat-forming plates is sealed, thereby forming a pleat that extends in a latitudinal direction of the film.

First Embodiment

In a first embodiment of the production method for a pleated film according to the present invention, an introduction process is performed first, followed by a fixing process and then a pleat-forming process.

Each process will be described in detail below.

(Introduction Process)

In the introduction process, the film is introduced into the gap part between the pair of pleat-forming plates so that the upstream-side inner surface and the downstream-side inner surface of the film oppose each other. The introduction process can be performed using at least one method among the following methods (A) to (C).

Method (A)

Figure 1:
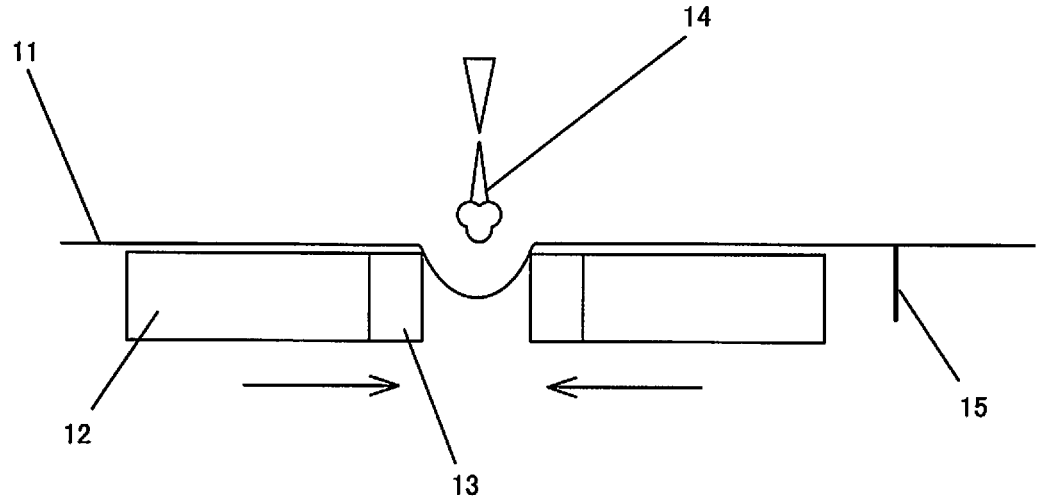
FIG. 1 is a schematic view illustrating a method for introducing a film into a gap between a pair of pleat-forming plates by blowing air thereon.

In method (A), as shown in FIG. 1, a film 11 is introduced into a gap part between a pair of pleat-forming plates 12, with respective sealing bars 13, disposed with a gap therebetween so that the upstream-side inner surface and the downstream-side inner surface of the film oppose each other by blowing air 14 from the inner surface side of the film. The air 14 may be supplied through a plurality of ejection holes provided in a pipe or the like, for example. By disposing the pipe on the inner surface side of the film 11 in the gap part between the pair of pleat-forming plates 12 so as to be parallel to a width direction of the film 11, the film 11 can be introduced into the gap part evenly. The air 14 is preferably supplied continuously until the film is sealed. By introducing the film 11 into the gap part using the air 14, the pleat 15 can be formed without damaging the part of the film 11 in which the pleat is to be formed. Moreover, since the film 11 is not rolled up from the gap part, formation defects in the pleat can be eliminated.

Method (B)

Figure 2:
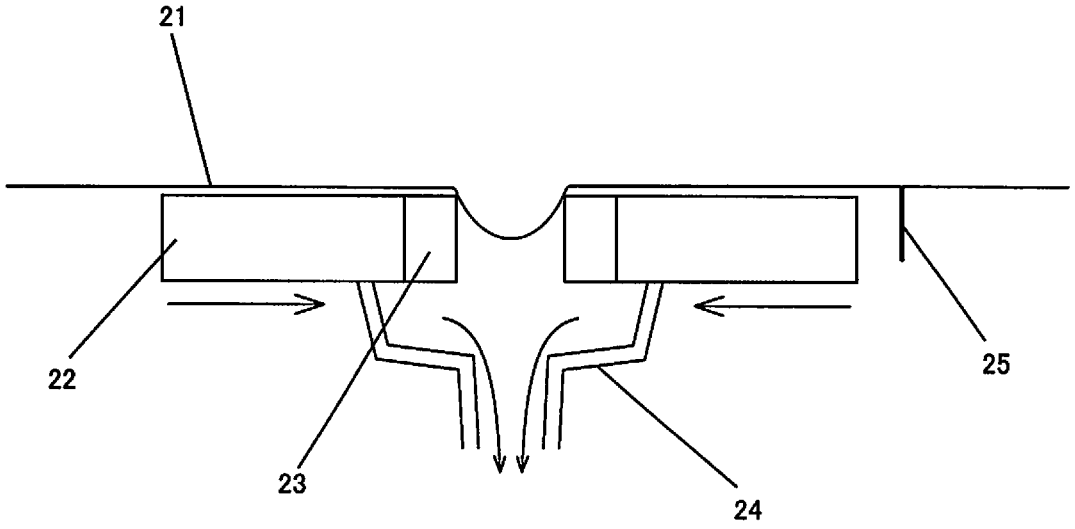
FIG. 2 is a schematic view illustrating a method for introducing the film into the gap between the pair of pleat-forming plates by means of deaeration using a suction member.

In method (B), as shown in FIG. 2, a film 21 is introduced into the gap part between a pair of pleat-forming plates 22, with respective sealing bars 23, so that the upstream-side inner surface and the downstream-side inner surface of the film 21 oppose each other by suctioning gas from the atmosphere through a suction member 24 disposed on the outer surface side of the gap part. By disposing the suction member 24 on the outer surface side of the entire gap part between the pair of pleat-forming plates 22 and suctioning gas from the atmosphere, the film 21 can be introduced into the gap part evenly. Gas is preferably suctioned from the atmosphere continuously until the film is sealed. By suctioning the film 21 together with the gas in the atmosphere, the pleat 25 can be formed without damaging the part of the film 21 in which the pleat is to be formed. Moreover, since the film 21 is not rolled up from the gap part, formation defects in the pleat can be eliminated.

Method (C)

Figure 3:
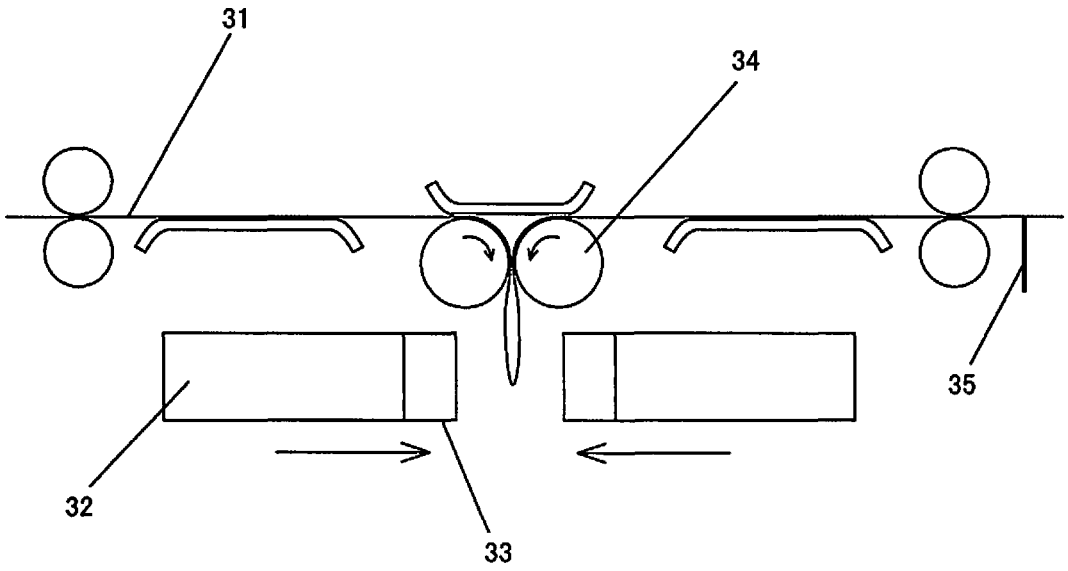
FIG. 3 is a schematic view illustrating a method for introducing the film into the gap between the pair of pleat-forming plates using a pair of rollers disposed on an outer surface side of the film.

In method (C), as shown in FIG. 3, a film 31 is introduced into the gap between a pair of pleat-forming plates 32, with respective sealing bars 33, so that the upstream-side inner surface and the downstream-side inner surface of the film 31 oppose each other by a pair of rollers 34 disposed on the outer surface side of the film 31. By disposing the pair of rollers 34 parallel with the gap part between the pair of pleat-forming plates 32, the film 31 can be introduced into the gap part evenly. Driving of the pair of rollers 34 may be stopped at a stage where an appropriate amount of the film 31 is hanging down into the gap part. By introducing the film 31 into the gap part using the pair of rollers 34, the pleat 35 can be formed without damaging the part of the film 31 in which the pleat is to be formed. Moreover, since the film 31 is not rolled up from the gap part, formation defects in the pleat can be eliminated.

As noted above, the introduction process may be performed using any of methods (A), (B), and (C). Moreover, these methods may be combined.

Further, when introducing the film into the gap between the pair of pleat-forming plates, an amount of the film required to form the pleat is preferably fed by nip rolls disposed respectively on the upstream side and the downstream side of the pair of pleat-forming plates. In so doing, the size of the pleat can be kept constant.

(Fixing Process)

In the fixing process, the film is fixed to the pair of pleat-forming plates. In the first embodiment of the production method for a pleated film according to the present invention, the fixing process is performed in a state where the film has been introduced into the gap part between the pair of pleat-forming plates disposed with a gap therebetween. Thus, the relative positions of the film and the pleat-forming plates do not deviate from each other in a state where the film has been introduced into the gap part between the pleat-forming plates, and as a result, pleat formation can be performed with stability.

There are no particular limitations on the method for fixing the film to the pair of pleat-forming plates, but the fixing process is preferably performed using methods shown in FIGS. 4 to 7, for example. When the pleat is to be formed, or more specifically when the gap between the pair of pleat-forming plates is to be closed, a neat pleat can be formed with stability by fixing the film to the pleat-forming plates. Note that although FIGS. 4 to 7 show states in which the film has not been introduced into the gap part between the pair of pleat-forming plates, in actuality, in the first embodiment of the production method for a pleated film according to the present invention, as noted above, the film is introduced into the gap part between the pair of pleat-forming plates.

Figure 4:
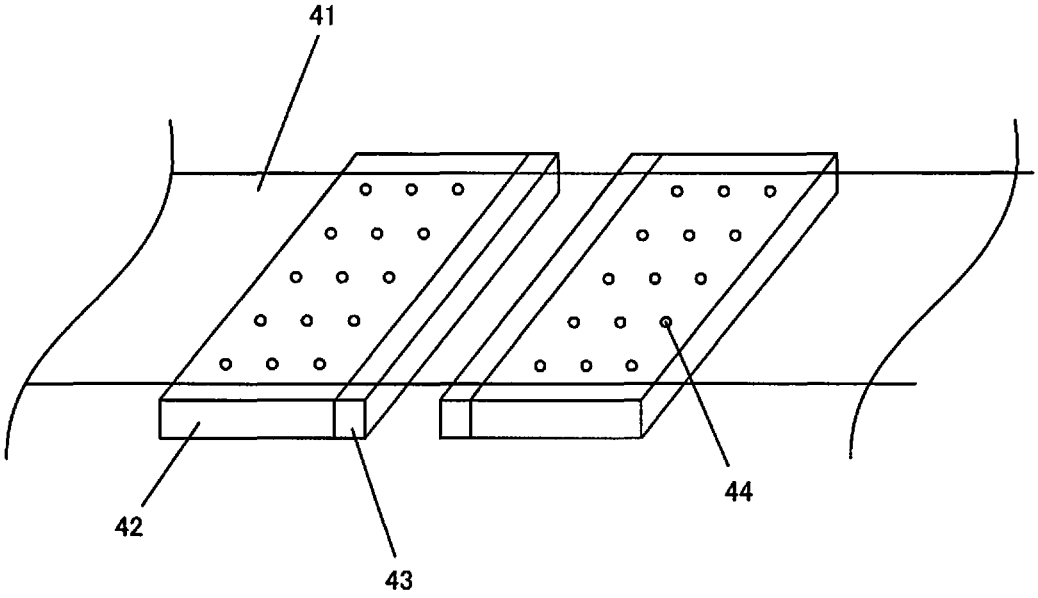
FIG. 4 is a schematic view illustrating a method for fixing the film to the pleat-forming plates by suctioning gas from the atmosphere through a plurality of holes provided in the pleat-forming plates.

In the example shown in FIG. 4, a film 41 is fixed to pleat-forming plates 42, with respective sealing bars 43, by suctioning gas from the atmosphere through a plurality of holes 44 provided in the pleat-forming plates 42. The holes 44 are preferably arranged evenly in one surface of each pleat-forming plate 42. Thus, the film 41 and the pleat-forming plates 42 can be fixed with stability.

Figure 5:
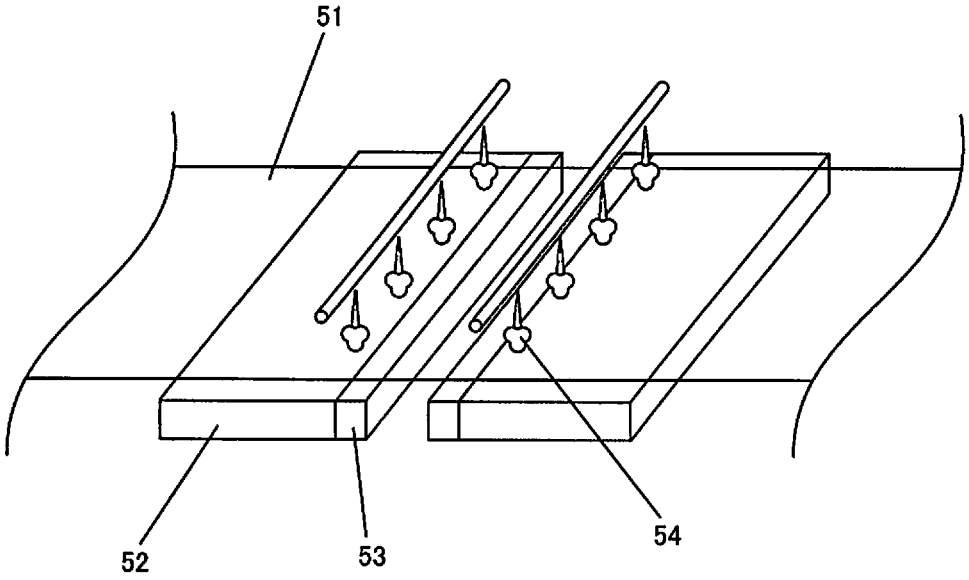
FIG. 5 is a schematic view illustrating a method for fixing the film to the pleat-forming plates by blowing air from an inner surface side of the film.

In the example shown in FIG. 5, a film 51 is fixed to pleat-forming plates 52, with respective sealing bars 53, by blowing air 54 from the inner surface side of the film 51. The air 54 may be supplied through a plurality of ejection holes provided in a pipe or the like, for example. By disposing the pipe parallel with the width direction of the film 51 and ejecting the air 54 toward the film 51, the film 51 and the pleat-forming plates 52 can be fixed with stability.

Figure 6:
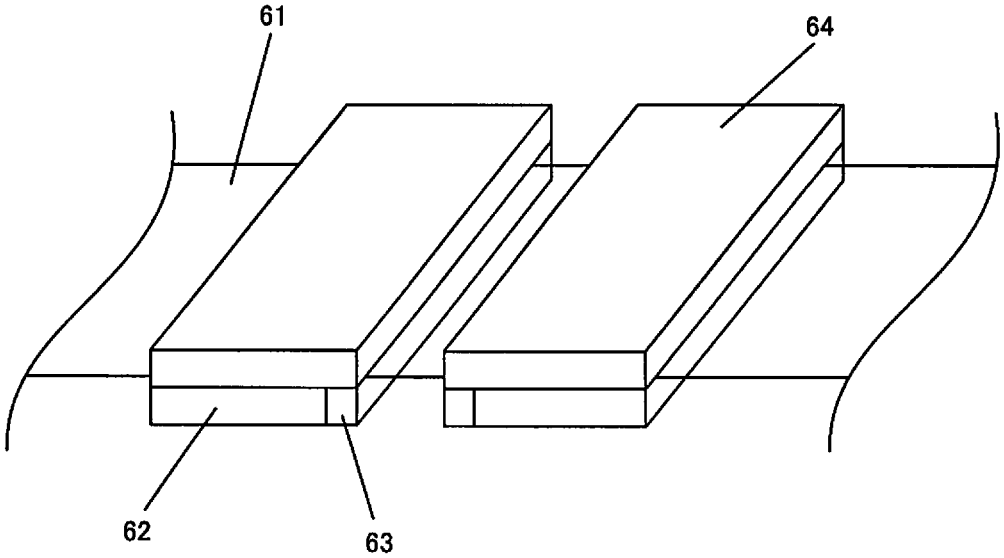
FIG. 6 is a schematic view illustrating a method for fixing the film to the pleat-forming plates by gripping the film between a pair of film-retaining plates provided on the inner surface side of the film and the pair of pleat-forming plates.

In the example shown in FIG. 6, a film 61 is fixed to a pair of pleat-forming plates 62, with respective sealing bars 63, by gripping the film 61 between a pair of film-retaining plates 64 provided on the inner surface side of the film 61 and the pair of pleat-forming plates 62. The pair of film-retaining plates 64 may be either approximately identical in size to the pleat-forming plates 62, as shown in FIG. 6, or smaller than the pleat-forming plates 62. When film-retaining plates 64 that are smaller than the pleat-forming plates 62 are used, the film-retaining plates 64 are preferably at least wide enough to cover the width direction of the film 61. By gripping the film 61 between the film-retaining plates 64 and the pleat-forming plates 62, the film 61 and the pleat-forming plates 62 can be fixed with stability.

Figure 7:
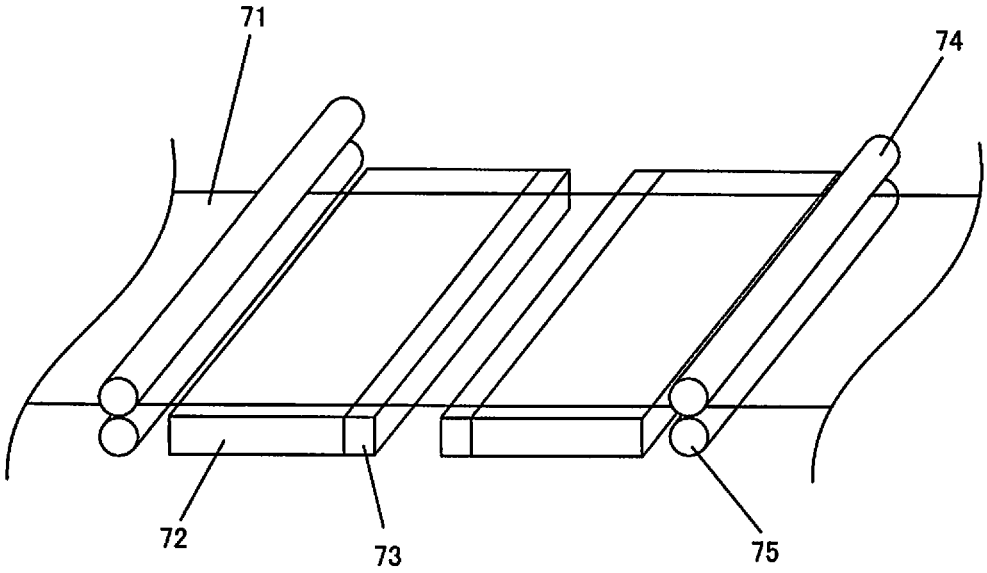
FIG. 7 is a schematic view illustrating a method for fixing the film to the pleat-forming plates by gripping the film between an inner surface-side roller and an outer surface-side roller provided respectively on an upstream side and a downstream side of the pair of pleat-forming plates.

In the example shown in FIG. 7, a film 71 is fixed to a pair of pleat-forming plates 72, with respective sealing bars 73, by gripping the film 71 between an inner surface-side roller 74 and an outer surface-side roller 75 provided respectively on the upstream side and the downstream side of the pair of pleat-forming plates 72. When the inner surface-side roller 74 and the outer surface-side roller 75 are provided close to the pleat-forming plates 72, the film 71 and the pleat-forming plates 72 can be fixed with greater stability than when the inner surface-side roller 74 and the outer surface-side roller 75 are provided somewhat distanced from the pleat-forming plates 72.

Note that any of the methods described above, namely a method of suctioning gas from the atmosphere through a plurality of holes provided in the pleat-forming plates, a method of blowing air onto the film, a method of gripping the film between a pair of film-retaining plates and the pair of pleat-forming plates, and a method of gripping the film between an inner surface-side roller and an outer surface-side roller provided respectively on the upstream side and the downstream side of the pair of pleat-forming plates, may be used as the method for fixing the film to the pair of pleat-forming plates. Moreover, these methods may be combined.

(Pleat-Forming Process)

In the pleat-forming process, a pleat extending in the latitudinal direction of the film is formed by closing the gap between the pair of pleat-forming plates.

By bringing the pair of pleat-forming plates close to each other so as to close the gap therebetween after fixing the film to the pleat-forming plates, the respective inner surfaces of the film can be sealed by the sealing bars provided on the opposing surfaces of the pleat-forming plates, and as a result, a pleat extending in the latitudinal direction of the film can be formed.

Second Embodiment

In a second embodiment of the production method for a pleated film according to the present invention, the fixing process is performed first, followed by the introduction process and then the pleat-forming process.

(Fixing Process)

In the second embodiment of the production method for a pleated film according to the present invention, the fixing process for fixing the film to the pair of pleat-forming plates is performed before introducing the film into the gap part between the pair of pleat-forming plates. In so doing, the relative positions of the film and the pleat-forming plates do not deviate from each other, and when the pair of pleat-forming plates disposed with a gap therebetween are brought close together in order to close the gap, an amount of film corresponding to the movement of the pleat-forming plates can be introduced into the gap part as the pleat.

There are no particular limitations on the method for fixing the film to the pair of pleat-forming plates. For example, the fixing process may be performed using the methods shown in FIGS. 4 to 7, similarly to the fixing process of the first embodiment of the production method for a pleated film according to the present invention, described above.

(Introduction Process)

In the second embodiment of the production method for a pleated film according to the present invention, the introduction process is performed after the fixing process. When the introduction process is performed, the film is fixed to the pair of pleat-forming plates, and therefore the introduction process is performed while closing the gap between the pair of pleat-forming plates.

As an introduction method for introducing the film into the gap part between the pair of pleat-forming plates so that the upstream-side inner surface and the downstream-side inner surface of the film oppose each other, method (A) and/or method (B) described above may be used, similarly to the introduction process of the first embodiment of the production method for a pleated film according to the present invention.

(Pleat-Forming Process)

By bringing the pair of pleat-forming plates close together until the gap therebetween is fully closed, the film is sealed by the sealing bars provided on the opposing surfaces of the pleat-forming plates, and as a result, a pleat extending in the latitudinal direction of the film can be formed.

[Method for Producing a Pleated Film Having a Cut-Out Portion in a Part of the Pleat]

By forming a cut-out portion in advance in a part of the film and forming a pleat using the film having the cut-out portion therein, a pleated film having a cut-out portion in a part of the pleat can be manufactured. The cut-out portion formed in advance in the film may be formed in the part of the film that is to serve as the part forming the pleat.

A pleated film having a cut-out portion in a part of the pleat can be manufactured using the methods described above. Preferably, however, either a pleat extending in the latitudinal direction of the film is formed first, whereupon a portion of the film in the part forming the pleat is cut out using a die or a blade, or a portion of the film in the part forming the pleat extending in the latitudinal direction of the film is cut out while forming the pleat by closing the gap between the pleat-forming plates. In so doing, the sealing precision of the pleat can be improved in comparison with a case where the pleat is formed after cutting out a portion of the film. In order to cut out a portion of the film in the part forming the pleat while forming the pleat, a die or a blade may be provided on a part of the sealing bars disposed on the opposing surfaces of the pair of pleat-forming plates, for example.

Third Embodiment

A third embodiment of the production method for a pleated film according to the present invention includes a process for cutting out a portion of the film in the part forming the pleat extending in the latitudinal direction of the film with a die or a blade after forming the pleat in accordance with the first embodiment or the second embodiment, described above. By cutting out a portion of the pleat after forming the pleat, the sealing precision of the pleat can be improved in comparison with a case where the pleat is formed after cutting out a portion of the film.

Fourth Embodiment

In a fourth embodiment of the production method for a pleated film according to the present invention, a portion of the film in the part forming the pleat extending in the latitudinal direction of the film is cut out during the pleat-forming process of the first embodiment or the second embodiment, described above, while forming the pleat by closing the gap between the pair of pleat-forming plates. As a result, similarly to the third embodiment, the sealing precision of the pleat can be improved in comparison with a case where the pleat is formed after cutting out a portion of the film. In order to cut out a portion of the film in the part forming the pleat while forming the pleat, a die or a blade may be provided on a part of the sealing bars disposed on the opposing surfaces of the pair of pleat-forming plates.

Figure 8:
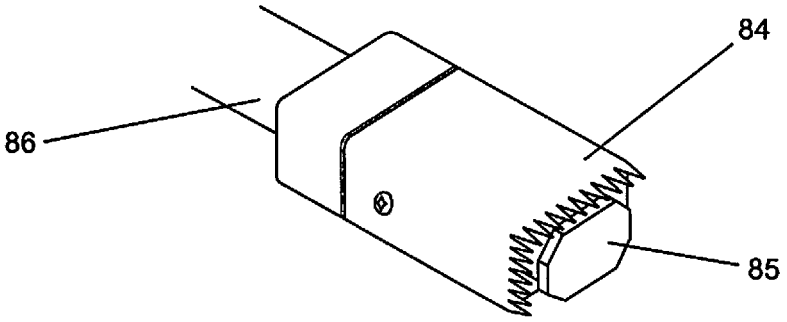
FIG. 8 is a schematic view illustrating an example of means for cutting out a portion of the film in the part where the pleat is formed using a blade.
Figure 9:
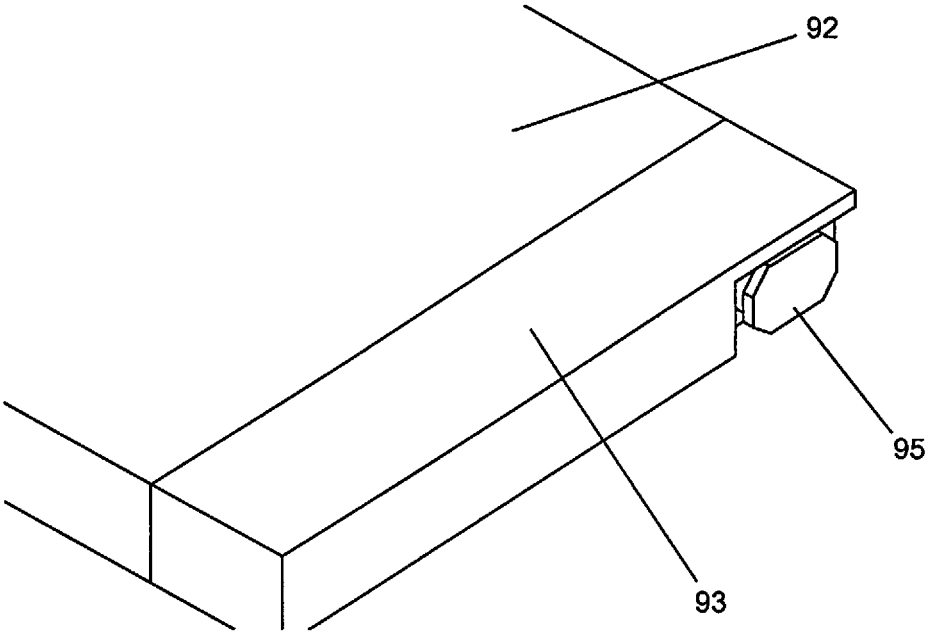
FIG. 9 is a schematic view illustrating an example in which the means for cutting out a portion of the film in the part where the pleat is formed using a blade is provided on an end portion of a sealing bar.

FIG. 8 shows an example of means for cutting out a portion of the film in the part where the pleat is formed using a blade 84. Further, FIG. 9 shows an outline of an example in which the means shown in FIG. 8 is provided on the end portion of a sealing bar 93 of a pleat-forming plate 92. When a pillow-type bag is manufactured using the pleated film, the cut-out portion of the pleat serves as a part in which a center seal portion of the pillow-type bag is to be formed, and therefore, as shown in FIGS. 8 and 9, the die or blade may be provided on the end portion of at least one of the sealing bars. An air cylinder 86 and a retaining plate 85 are also provided in conjunction with the blade 84 as shown in FIG. 8, and a retaining plate 95 is shown in FIG. 9.

Next, using FIGS. 10 to 14, methods for cutting out a portion of the pleat when forming the pleat by sealing the film into a shape of palm-folding type will be described. Note that there are no particular limitations on the method for sealing the film in order to form the pleat, and heat-sealing, high-frequency sealing, or the like, for example, may be employed. An example of a case in which the film is heat-sealable and the pleat is formed by heat-sealing will be described below.

Figure 10:
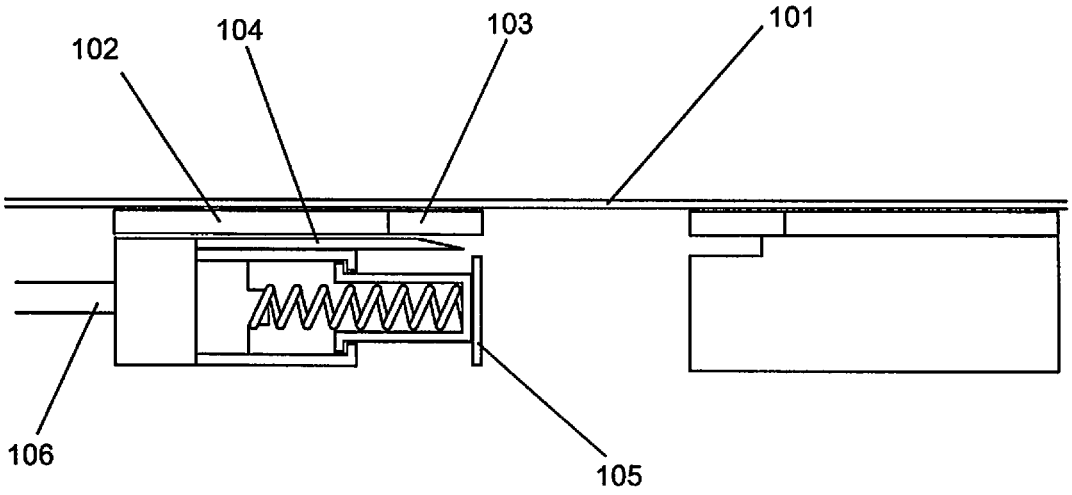
FIG. 10 is a schematic view illustrating a pleat-forming plate having a blade on a part of the sealing bar.

First, as shown in FIG. 10, a film 101 is conveyed so that a pair of pleat-forming plates 102 are positioned on the outer surface side of the film 101. Sealing bars 103 are provided on the opposing surfaces of the pleat-forming plates. Further, a blade 104 for cutting out a portion of the film 101 is disposed on the end portion of one of the pleat-forming plates 102. A retaining plate 105 and an air cylinder 106 are also shown in FIG. 10.

Figure 11:
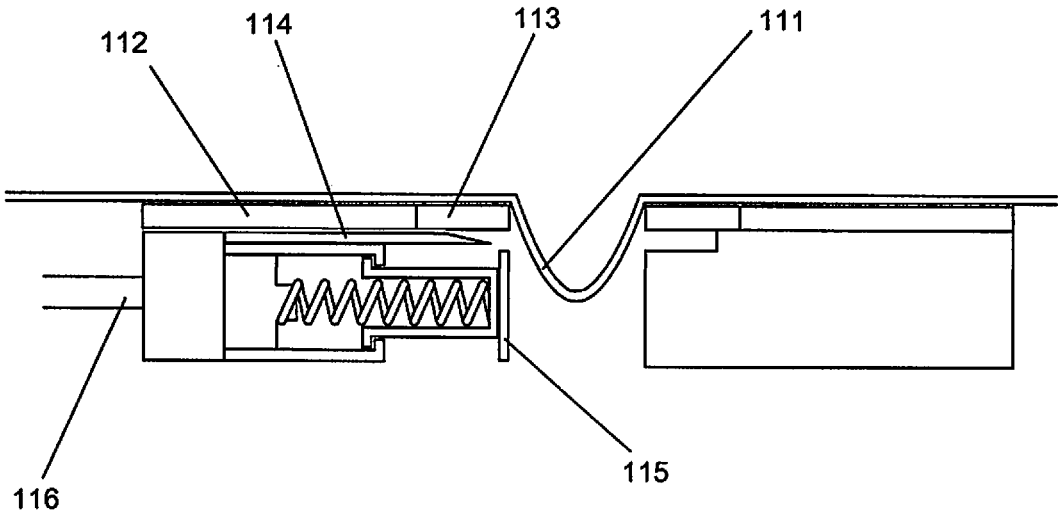
FIG. 11 is a schematic view illustrating a state in which the film is inserted between pleat-forming plates having a blade on a part of the sealing bar.

Next, as shown in FIG. 11, a film 111 is introduced into the gap between a pair of pleat-forming plates 112, with respective sealing bars 113, and the film 111 is fixed to the pleat-forming plates 112. Note that here, an example in which the fixing process is performed after the introduction process, as in the first embodiment, has been described, but the introduction process may be performed after the fixing process, as in the second embodiment. In this case, first, in the state shown in FIG. 10, the film 101 should be fixed to the pair of pleat-forming plates 102, and then, in the state shown in FIG. 11, the film 111 should be introduced into the gap between the pair of pleat-forming plates 112 while closing the gap. A blade 114, a retaining plate 115 and an air cylinder 116 are also shown in FIG. 11.

Figure 12:
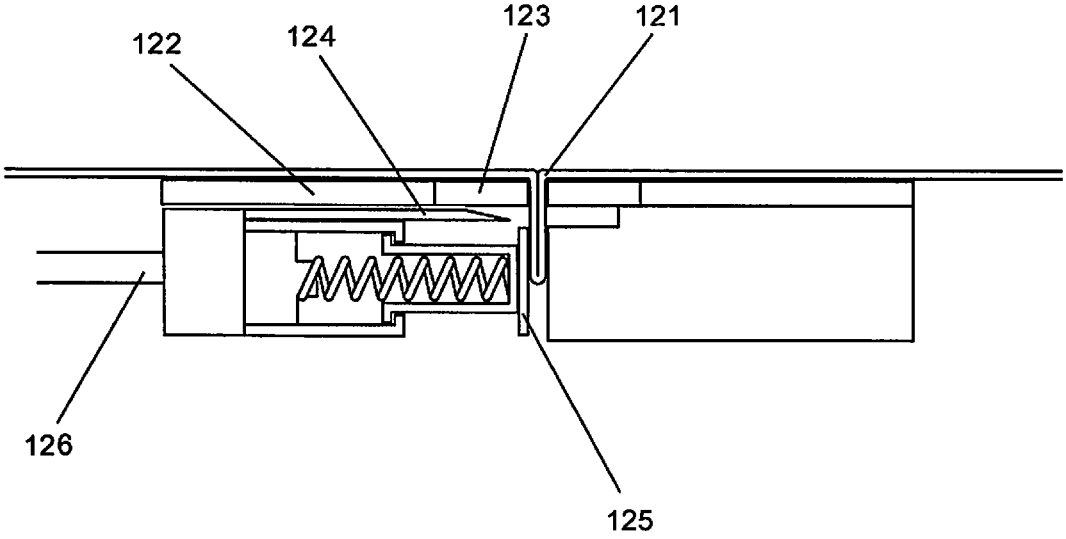
FIG. 12 is a schematic view illustrating a state in which the film is gripped between the pleat-forming plates having a blade on a part of the sealing bar.

Next, as shown in FIG. 12, a pair of pleat-forming plates 122 are brought close together in order to close the gap therebetween, whereupon the inner surfaces of a part of a film 121 gripped between sealing bars 123 are sealed. Note that in FIG. 12, in order to illustrate the action of the blade provided on a part of the sealing bar, only a part of the width direction end portion of the pleat-forming plate is shown. A blade 124, a retaining plate 125 and an air cylinder 126 are also shown in FIG. 12.

Figure 13:
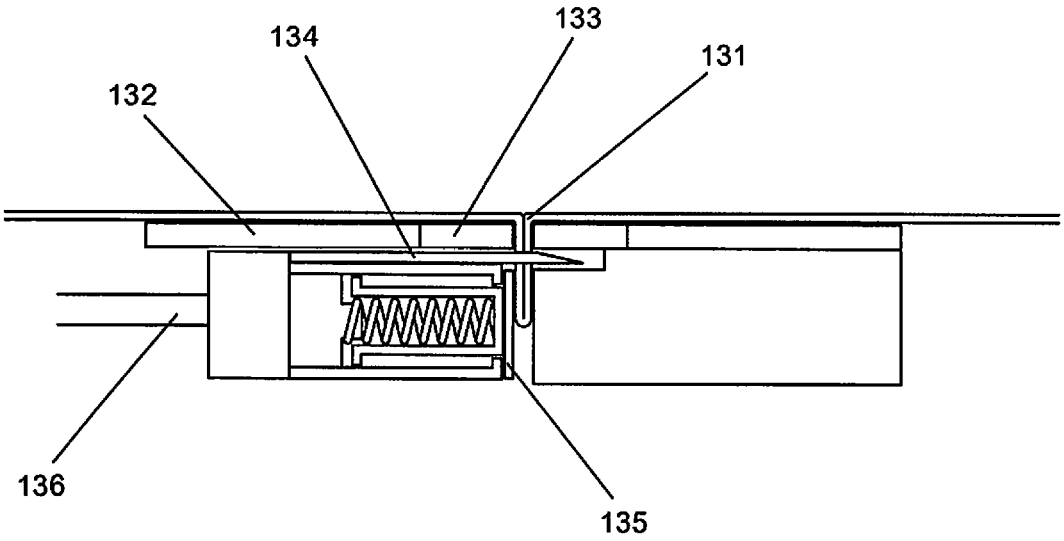
FIG. 13 is a schematic view illustrating a state in which a portion of the film in the part where the pleat is to be formed is cut out by the blade provided on a part of the sealing bar.
Figure 14:
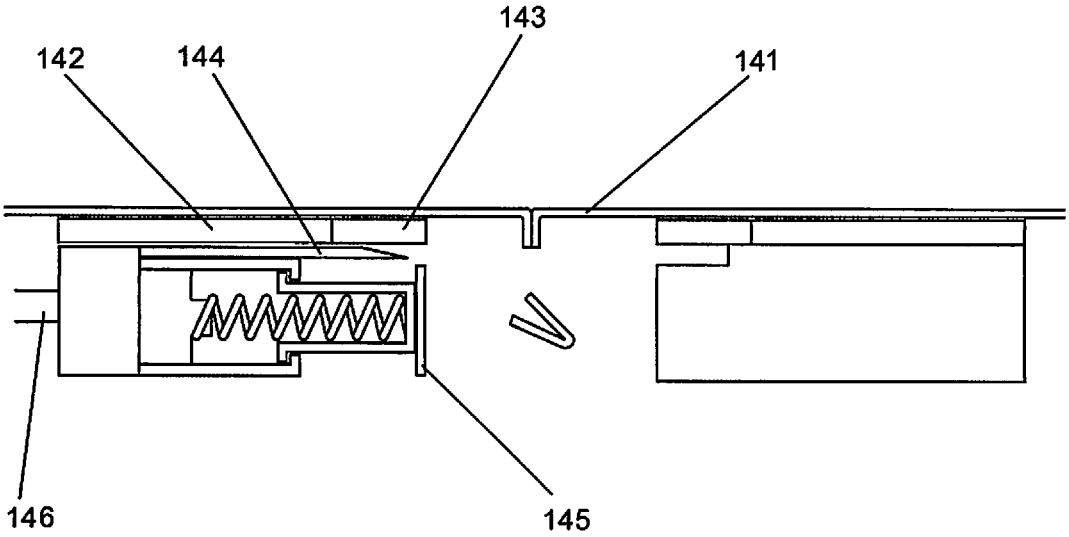
FIG. 14 is a schematic view illustrating a state in which cutting out of a portion of the film in the part where the pleat is to be formed using the blade provided on a part of the sealing bar is complete.
Figure 15:
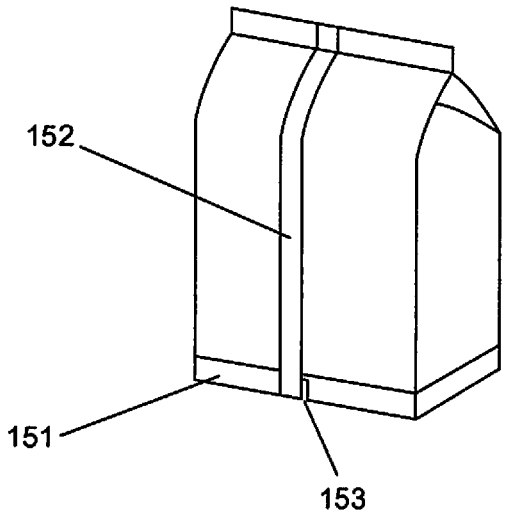
FIG.15 PRIOR ART
FIG. 15, Prior Art, is a schematic view illustrating a pleated self-standing packaging body in which a cut-out portion is formed in a part of the pleat.

Next, as shown in FIG. 13, a cutter or blade 134 and a retaining plate 135 are pressed by an air cylinder 136. A sealing bar 133 and a pleat-forming plate 132 are also shown in FIG. 13. As a result, a portion of a film 131 is cut out by the cutter 134 while being retained by the retaining plate 135. Next, as shown in FIG. 14, a pair of pleat-forming plates 142, with respective sealing bars 143, are separated again, and thus a pleated film 141 provided with a cut-out portion in a part of the pleat is manufactured. A blade 144, a retaining plate 145 and an air cylinder 146 are also shown in FIG. 14.

Thereafter, the fixed state between the film and the pleat-forming plates may be released, the film may be conveyed, and the series of operations may be repeated. Further, the manufactured pleated film may be wound up into a roll or put to immediate use in manufacturing a pleated packaging body.

<Production Method of Pleated Packaging Body>

A production method of a pleated packaging body according to an aspect of the present invention is a method for producing a pleated packaging body by supplying the pleated film obtained using the production method for a pleated film of the present invention, described above, to a packaging machine capable of producing a pillow-type packaging body. Either a horizontal pillow packaging machine or a vertical pillow packaging machine may be used to manufacture the pleated packaging body. Further, manufacture of the pleated film and manufacture of the pleated packaging body may be performed either continuously by in-line manufacture or separately by out-line manufacture.

When a horizontal pillow packaging machine is used, a pleated packaging body can be manufactured by supplying the pleated film obtained using the production method for a pleated film of the present invention to a horizontal pillow packaging machine that is capable of producing a pillow-type packaging body by including means described below in [1] to [5].

[1] Means for conveying the film

[2] Means for forming the film into a tubular shape and housing content therein

[3] Means for forming a center seal in the tubular film

[4] Means for simultaneously sealing a part of the center-sealed film that is to serve as an upstream-side end of a downstream-side packaging body and a part of the center-sealed film that is to serve as a downstream-side end of an upstream-side packaging body

[5] Means for cutting the part sealed by the means described in [4] substantially in the center thereof in order to separate the film that is to serve as the upstream-side packaging body from the downstream-side packaging body Note that when sealing is performed using the means described in [4], the downstream-side end of the film serving as the downstream-side packaging body is already sealed, while the part that is to serve as the upstream-side end of the upstream-side packaging body is left as an open end.

The means described in [4] and the means described in [5] may be constituted by single means doubling as both means, such as a sealer in which a cutter blade is provided substantially in the center of a sealing bar, for example. Further, by employing a box motion-type sealer, the packaging body can be manufactured while conveying the film continuously.

When a vertical pillow packaging machine is used, a pleated packaging body can be manufactured by supplying the pleated film obtained using the production method for a pleated film of the present invention to a vertical pillow packaging machine that is capable of producing a pillow-type packaging body by including means described below in <1> to <7>.

<1> Means for conveying the film

<2> Means for forming the film into a tubular shape

<3> Means for forming a center seal in the tubular film

<4> Means for simultaneously sealing the part of the center-sealed film that is to serve as the upstream-side end of the downstream-side packaging body and the part that is to serve as the downstream-side end of the upstream-side packaging body <5> Means for cutting the part sealed by the means described in <4> substantially in the center thereof in order to separate the film that is to serve as the upstream-side packaging body from the downstream-side packaging body <6> Means for supplying content through an open end of the film that is to serve as the upstream-side packaging body <7> Means for delivering an amount of film corresponding to a single pitch Note that when sealing is performed using the means described in <4>, the downstream-side end of the film serving as the downstream-side packaging body is already sealed and the content is housed therein.

Further, when supplying the content using the means described in <6>, the downstream-side end of the film serving as the upstream-side packaging body is already sealed, and therefore the content is stopped by the sealed portion on the downstream-side end.

The means described in <4> and the means described in <5> may be constituted by single means doubling as both means, such as a sealer in which a cutter blade is provided substantially in the center of a sealing bar, for example. When a vertical pillow packaging machine is used, the film is usually conveyed intermittently.

The invention claimed is:

1. A production method for a pleated film, comprising:

an introduction step for moving an elongated film for use as a packaging body in a longitudinal direction of the film and introducing the film into a gap part between a pair of pleat-forming plates disposed with a gap therebetween so that an upstream-side inner surface and a downstream-side inner surface of the film oppose each other;

a fixing step for fixing the film to the pair of pleat-forming plates;

a pleat-forming step for forming a pleat extending in a latitudinal direction of the film by closing the gap between the pair of pleat-forming plates; and a step for cutting out a portion of the film in a part where the pleat is to be formed using a die or a blade following the pleat-forming step, wherein:

sealing bars are provided on the pair of pleat-forming plates on opposing surfaces of the pair of pleat-forming plates, and the introduction step is performed using one or more of the following methods (A) to (C):

(A) a method in which the film is introduced into the gap between the pair of pleat-forming plates so that the upstream-side inner surface and the downstream-side inner surface of the film oppose each other by blowing air from an inner surface side of the film;

(B) a method in which the film is introduced into the gap between the pair of pleat-forming plates so that the upstream-side inner surface and the downstream-side inner surface of the film oppose each other by suctioning gas from the atmosphere through a suction member disposed on an outer surface side of the gap part between the pair of pleat-forming plates; and (C) a method in which the film is introduced into the gap between the pair of pleat-forming plates so that the upstream-side inner surface and the downstream-side inner surface of the film oppose each other by a pair of rollers disposed on an outer surface side of the film.

2. The production method for a pleated film according to claim 1, wherein the film is fixed to the pair of pleat-forming plates by suctioning gas from the atmosphere through a plurality of holes provided in the pair of pleat-forming plates.

3. The production method for a pleated film according to claim 1, wherein the film is fixed to the pair of pleat-forming plates by blowing air from the inner surface side of the film.

4. The production method for a pleated film according to claim 1, wherein the film is fixed to the pair of pleat-forming plates by gripping the film between a pair of film-retaining plates provided on the inner surface side of the film and the pair of pleat-forming plates.

5. A production method of a pleated packaging body, comprising producing a pleated packaging body by supplying the pleated film obtained using the production method for a pleated film according to claim 1 to a packaging machine capable of producing a pillow-type packaging body.

6. A production method for a pleated film, comprising:

a fixing step for moving an elongated film for use as a packaging body in a longitudinal direction of the film and fixing the film to a pair of pleat-forming plates disposed with a gap therebetween;

an introduction step for introducing the film into a gap part between the pair of pleat-forming plates so that an upstream-side inner surface and a downstream-side inner surface of the film oppose each other while closing the gap between the pair of pleat-forming plates;

a pleat-forming step for forming a pleat extending in a latitudinal direction of the film by closing the gap between the pair of pleat-forming plates; and a step for cutting out a portion of the film in a part where the pleat is to be formed using a die or a blade following the pleat-forming step, wherein:

sealing bars are provided on the pair of pleat-forming plates on opposing surfaces of the pair of pleat-forming plates, and the introduction step is performed using a following method (A) and/or the following method (B):

(A) a method in which the film is introduced into the gap between the pair of pleat-forming plates so that the upstream-side inner surface and the downstream-side inner surface of the film oppose each other by blowing air from an inner surface side of the film; and (B) a method in which the film is introduced into the gap between the pair of pleat-forming plates so that the upstream-side inner surface and the downstream-side inner surface of the film oppose each other by suctioning gas from the atmosphere through a suction member disposed on an outer surface side of the gap part between the pair of pleat-forming plates.

7. The production method for a pleated film according to claim 6, wherein the film is fixed to the pair of pleat-forming plates by suctioning gas from the atmosphere through a plurality of holes provided in the pair of pleat-forming plates.

8. The production method for a pleated film according to claim 6, wherein the film is fixed to the pair of pleat-forming plates by blowing air from the inner surface side of the film.

9. The production method for a pleated film according to claim 6, wherein the film is fixed to the pair of pleat-forming plates by gripping the film between a pair of film-retaining plates provided on the inner surface side of the film and the pair of pleat-forming plates.

10. A production method of a pleated packaging body, comprising producing a pleated packaging body by supplying the pleated film obtained using the production method for a pleated film according to claim 6 to a packaging machine capable of producing a pillow-type packaging body.

11. A production method for a pleated film, comprising:

an introduction step for moving an elongated film for use as a packaging body in a longitudinal direction of the film and introducing the film into a gap part between a pair of pleat-forming plates disposed with a gap therebetween so that an upstream-side inner surface and a downstream-side inner surface of the film oppose each other;

a fixing step for fixing the film to the pair of pleat-forming plates; and a pleat-forming step for forming a pleat extending in a latitudinal direction of the film by closing the gap between the pair of pleat-forming plates, wherein:

sealing bars are provided on the pair of pleat-forming plates on opposing surfaces of the pair of pleat-forming plates, while forming the pleat extending in the latitudinal direction of the film by closing the gap between the pair of pleat-forming plates in the pleat-forming step, a portion of the film in a part where the pleat is to be formed is cut out using a die or a blade disposed on a part of one of the sealing bars, and the introduction step is performed using one or more of the following methods (A) to (C):

(A) a method in which the film is introduced into the gap between the pair of pleat-forming plates so that the upstream-side inner surface and the downstream-side inner surface of the film oppose each other by blowing air from an inner surface side of the film;

(B) a method in which the film is introduced into the gap between the pair of pleat-forming plates so that the upstream-side inner surface and the downstream-side inner surface of the film oppose each other by suctioning gas from the atmosphere through a suction member disposed on an outer surface side of the gap part between the pair of pleat-forming plates; and (C) a method in which the film is introduced into the gap between the pair of pleat-forming plates so that the upstream-side inner surface and the downstream-side inner surface of the film oppose each other by a pair of rollers disposed on an outer surface side of the film.

12. The production method for a pleated film according to claim 11, wherein the film is fixed to the pair of pleat-forming plates by suctioning gas from the atmosphere through a plurality of holes provided in the pair of pleat-forming plates.

13. The production method for a pleated film according to claim 11, wherein the film is fixed to the pair of pleat-forming plates by blowing air from the inner surface side of the film.

14. The production method for a pleated film according to claim 11, wherein the film is fixed to the pair of pleat-forming plates by gripping the film between a pair of film-retaining plates provided on the inner surface side of the film and the pair of pleat-forming plates.

15. A production method of a pleated packaging body, comprising producing a pleated packaging body by supplying the pleated film obtained using the production method for a pleated film according to claim 11 to a packaging machine capable of producing a pillow-type packaging body.

16. A production method for a pleated film, comprising:

a fixing step for moving an elongated film for use as a packaging body in a longitudinal direction of the film and fixing the film to a pair of pleat-forming plates disposed with a gap therebetween;

an introduction step for introducing the film into a gap part between the pair of pleat-forming plates so that an upstream-side inner surface and a downstream-side inner surface of the film oppose each other while closing the gap between the pair of pleat-forming plates; and a pleat-forming step for forming a pleat extending in a latitudinal direction of the film by closing the gap between the pair of pleat-forming plates, wherein:

sealing bars are provided on the pair of pleat-forming plates on opposing surfaces of the pair of pleat-forming plates, while forming the pleat extending in the latitudinal direction of the film by closing the gap between the pair of pleat-forming plates in the pleat-forming step, a portion of the film in a part where the pleat is to be formed is cut out using a die or a blade disposed on a part of one of the sealing bars, and the introduction step is performed using the following method (A) and/or the following method (B):

(A) a method in which the film is introduced into the gap between the pair of pleat-forming plates so that the upstream-side inner surface and the downstream-side inner surface of the film oppose each other by blowing air from an inner surface side of the film; and (B) a method in which the film is introduced into the gap between the pair of pleat-forming plates so that the upstream-side inner surface and the downstream-side inner surface of the film oppose each other by suctioning gas from the atmosphere through a suction member disposed on an outer surface side of the gap part between the pair of pleat-forming plates.

17. The production method for a pleated film according to claim 16, wherein the film is fixed to the pair of pleat-forming plates by suctioning gas from the atmosphere through a plurality of holes provided in the pair of pleat-forming plates.

18. The production method for a pleated film according to claim 16, wherein the film is fixed to the pair of pleat-forming plates by blowing air from the inner surface side of the film.

19. The production method for a pleated film according to claim 16, wherein the film is fixed to the pair of pleat-forming plates by gripping the film between a pair of film-retaining plates provided on the inner surface side of the film and the pair of pleat-forming plates.

20. A production method of a pleated packaging body, comprising producing a pleated packaging body by supplying the pleated film obtained using the production method for a pleated film according to claim 16 to a packaging machine capable of producing a pillow-type packaging body.

* * * * *